US011957947B2

(12) United States Patent
Wang

(10) Patent No.: US 11,957,947 B2
(45) Date of Patent: Apr. 16, 2024

(54) VOLUTE ROTARY RESETTING MECHANISM AND ROWING MACHINE

(71) Applicant: Qiulin Wang, Longyan (CN)

(72) Inventor: Qiulin Wang, Longyan (CN)

( * ) Notice: Subject to any disclaimer, the term of this patent is extended or adjusted under 35 U.S.C. 154(b) by 81 days.

(21) Appl. No.: 17/913,842

(22) PCT Filed: Mar. 2, 2021

(86) PCT No.: PCT/CN2021/075326
§ 371 (c)(1),
(2) Date: Sep. 23, 2022

(87) PCT Pub. No.: WO2021/196885
PCT Pub. Date: Oct. 7, 2021

(65) Prior Publication Data

US 2023/0115485 A1 Apr. 13, 2023

(30) Foreign Application Priority Data

Apr. 3, 2020 (CN) ..... 202010260577.1

(51) Int. Cl.
*A63B 21/04* (2006.01)
*A63B 21/00* (2006.01)
(Continued)

(52) U.S. Cl.
CPC ..... *A63B 21/0435* (2013.01); *A63B 21/025* (2013.01); *A63B 21/153* (2013.01);
(Continued)

(58) Field of Classification Search
CPC . A63B 21/0435; A63B 21/025; A63B 21/153; A63B 21/22; A63B 22/0076;
(Continued)

(56) References Cited

U.S. PATENT DOCUMENTS 4,846,460 A * 7/1989 Duke ..... A63B 22/0076 482/73
4,884,800 A * 12/1989 Duke ..... A63B 21/154 482/73
(Continued)

FOREIGN PATENT DOCUMENTS

CN 204380080 6/2015
CN 206103203 4/2017
(Continued)

OTHER PUBLICATIONS

ISR of PCT/CN2021/075326.

*Primary Examiner* — Garrett K Atkinson
(74) *Attorney, Agent, or Firm* — Jose Cherson Weissbrot

(57) ABSTRACT

A volute rotary resetting mechanism is provided, including a rotating wheel (100) and a main shaft (200); the main shaft (200) is arranged on the rotating wheel (100) in a penetrating manner; a turntable part (110) and a resilience part (120) are axially distributed on the rotating wheel (100); the turntable part (110) is connected to the main shaft (200) through a one-way bearing (111), so that the rotating wheel (100) drives the main shaft (200) to rotate in one way; a volute spring (121) is arranged on the resilience part (120); an inner end of the volute spring (121) is fixed on the resilience part (120), and an outer end is fixed on a volute reel (122); and the rotating wheel (100) and the volute reel (122) are relatively rotatable, so that the volute spring (121) is tightened to generate a resilience force for rotary resetting of the rotating wheel (100). A rowing machine with the volute rotary resetting mechanism is further provided.

18 Claims, 2 Drawing Sheets

(51) Int. Cl.
*A63B 21/02* (2006.01)
*A63B 21/22* (2006.01)
*A63B 22/00* (2006.01)

(52) U.S. Cl.
CPC ..... *A63B 21/22* (2013.01); *A63B 22/0076* (2013.01); *A63B 2022/0079* (2013.01)

(58) Field of Classification Search
CPC ..... A63B 22/008; A63B 2022/00; A63B 2022/0079; A63B 21/00192; A63B 21/0084; A63B 69/06; A63B 23/12; A63B 71/0054; A63B 2071/009; A63B 21/4031; A63B 21/00061; A63B 21/02; A63B 21/023; A63B 21/0428; A63B 21/055; A63B 21/151; A63B 21/154; A63B 23/0222; A63B 2208/0219
See application file for complete search history.

(56) References Cited

U.S. PATENT DOCUMENTS 5,382,210 A * 1/1995 Rekers ..... A63B 21/157 482/125
5,876,052 A * 3/1999 Olson ..... B62K 3/005 280/220
6,206,394 B1 * 3/2001 Olson ..... B62K 3/005 280/304
6,817,968 B2 * 11/2004 Galbraith ..... A63B 21/0552 482/121
9,764,185 B2 * 9/2017 Lonergan ..... A63B 22/0087
11,724,151 B2 * 8/2023 Hansen ..... A63B 21/025 482/119
2004/0009849 A1 * 1/2004 Galbraith ..... A63B 22/0076 482/51
2005/0277521 A1 * 12/2005 Lat ..... A63B 22/0076 482/72
2006/0148622 A1 7/2006 Chen
2017/0043208 A1 * 2/2017 Lonergan ..... A63B 22/0087
2021/0394010 A1 * 12/2021 Hansen ..... A63B 21/015
2023/0338771 A1 * 10/2023 Hansen ..... A63B 21/025

FOREIGN PATENT DOCUMENTS

CN 108785970 A 11/2018
CN 209828077 A 12/2019
CN 111298410 6/2020
CN 212038899 12/2020

* cited by examiner

VOLUTE ROTARY RESETTING MECHANISM AND ROWING MACHINE

CROSS-REFERENCE TO RELATED APPLICATION

This application refers to China Patent Application No. 202010260577.1, filed on Apr. 3, 2020 and entitled "Volute Rotary Resetting Mechanism and Rowing Machine", which is incorporated by reference herein in its entirety.

TECHNICAL FIELD

The present disclosure relates to the technical field of gym equipment, in particular, to a volute rotary resetting mechanism and a rowing machine.

BACKGROUND

As people pay more and more attention to their health, proper exercises and fitness are also essential in addition to a reasonable diet and adequate sleep. In order to keep exercise and fitness as effective daily behaviors for a long time, and to avoid being affected by weather conditions and other factors as much as possible, most people use gym equipment to do exercises, so that people can do physical exercises at home.

Most sets of gym equipment achieve a strength-enhancing exercise effect mainly by setting different resistances. For example, a rowing machine is a kind of aerobic exercise apparatus that can improve the comprehensive abilities. Using the rowing machine to do exercise is like kayaking. During exercise time, muscles of the legs, the waist, the upper limbs and the back part work within short time due to the resistance of water and changes in the rotating speed of a rotating wheel.

A pullback mechanism of the existing rowing machine mainly generates a rotary resetting force by using an elastic string. The patent document No. CN209828073U, filed on Dec. 24, 2019 and entitled "Water Resistance Rowing Machine with Adjustable Resilience Force", discloses a water resistance rowing machine with adjustable resilience force, including a main rotating shaft, a pulling belt for pulling the main rotating shaft to do forward rotation, an elastic string for pulling the main rotating shaft to be reversely reset, and an adjusting device for adjusting the tightness of the elastic string. The adjusting device adjusts a rotary resetting force of the elastic string on the main rotating shaft by adjusting a stretching length of the elastic string, so as to adjust the resistance of the water resistance rowing machine. The adjusting device includes several limiting slots and at least one adjusting pulley. The adjusting pulley pulls the elastic string, and a center shaft of the adjusting pulley is clamped at different limiting slots to switch the stretching lengths of the elastic string by the adjusting device.

In this technical solution, the rowing machine is withdrawn by the elastic string, but the elastic string needs to be disposed around the machine, so that the elastic string is relatively long, resulting in rapid aging of the elastic string due to excessive deformation. Therefore, the structure is relatively complex and hard to install. Furthermore, the machine is easy to wear and needs to be frequently replaced.

SUMMARY

Technical Problem

The pullback mechanism of the existing rowing machine has a complex structure and is hard to install and easy to age since it generates a resilience force mainly by the elastic string.

Technical Solution

The present disclosure provides a volute rotary resetting mechanism, including a rotating wheel and a main shaft; the main shaft is arranged on the rotating wheel in a penetrating manner;

a turntable part and a resilience part are axially distributed on the rotating wheel; the turntable part is connected to the main shaft through a one-way bearing, so that the rotating wheel drives the main shaft to rotate in one way;

a volute spring is arranged on the resilience part; an inner end of the volute spring is fixed on the resilience part, and an outer end is fixed on a volute reel; and the rotating wheel and the volute reel are relatively rotatable, so that the volute spring is tightened to generate a resilience force for rotary resetting of the rotating wheel.

On the basis of the above structure, further, two ends of the volute spring are respectively fastened with hanging holes in the volute reel and the resilience part.

On the basis of the above structure, further, a material of the rotating wheel is plastic or aluminum alloy.

On the basis of the above structure, further, one end of the main shaft is provided with a resistance mechanism used for preventing the rotating wheel from rotating.

On the basis of the above structure, further, the resistance mechanism is a water resistor or a magnet resistor.

On the basis of the above structure, further, the water resistor includes a water tank and a paddle arranged in the water tank; and the paddle is fixed on the main shaft.

On the basis of the above structure, further, a handheld mechanism used for pulling the rotating wheel to rotate is arranged on the turntable part.

On the basis of the above structure, further, the handheld mechanism includes a pulling handle and a pulling belt; and one end of the pulling belt is fixed with the pulling handle, and the other end is fixed on the turntable part.

On the basis of the above structure, further, the pulling belt is a nylon woven belt.

The present disclosure further provides a rowing machine, including a rotating wheel and a main shaft; the main shaft is arranged on the rotating wheel in a penetrating manner;

a turntable part and a resilience part are axially distributed on the rotating wheel; the turntable part is connected to the main shaft through a one-way bearing, so that the rotating wheel drives the main shaft to rotate in one way;

a volute spring is arranged on the resilience part; an inner end of the volute spring is fixed on the resilience part, and an outer end is fixed on a volute reel; the rotating wheel and the volute reel are relatively rotatable, so that the volute spring is tightened to generate a resilience force for rotary resetting of the rotating wheel;

one end of the main shaft is provided with a resistance mechanism used for preventing the rotating wheel from rotating; and a handheld mechanism used for pulling the rotating wheel to rotate is arranged on the turntable part.

On the basis of the above structure, further, two ends of the volute spring are respectively fastened with hanging holes in the volute reel and the resilience part.

On the basis of the above structure, further, a material of the rotating wheel is plastic or aluminum alloy.

On the basis of the above structure, further, the resistance mechanism is a water resistor or a magnet resistor.

On the basis of the above structure, further, the water resistor includes a water tank and a paddle arranged in the water tank; and the paddle is fixed on the main shaft.

On the basis of the above structure, further, the handheld mechanism includes a pulling handle and a pulling belt; and one end of the pulling belt is fixed with the pulling handle, and the other end is fixed on the turntable part.

On the basis of the above structure, further, the pulling belt is a nylon woven belt.

On the basis of the above structure, further, the rowing machine further includes a main frame used for mounting the volute rotary resetting mechanism, the resistance mechanism and the handheld mechanism; the main frame includes a bottom cross beam, a middle cross beam and a top cross beam which are disposed from bottom to top; the water tank is located between the bottom cross beam and the middle cross beam; the rotating wheel is located between the middle cross beam and the top cross beam; and the volute reel is fixed on the middle cross beam.

On the basis of the above structure, further, a correction wheel and a guide wheel for changing a moving direction of the pulling belt are further arranged on the main frame.

Beneficial Effects

Compared with the prior art, the volute rotary resetting mechanism provided by the present disclosure has the following advantages:

1. The turntable part and the resilience part are axially distributed on the rotating wheel, so that it is convenient to replace the volute spring or a pulling component on the turntable part.
2. The two ends of the volute spring are respectively fixed to the resilience part and the volute reel; the rotating wheel and the volute reel are relatively rotatable, so that the volute spring is tightened to generate a resilience force; and the turntable part is connected to the main shaft through the one-way bearing, so that the rotating wheel will not drive the main shaft to rotate during rotary resetting.
3. The resistance mechanism used for preventing the rotating wheel from forwardly rotating can be arranged on the main shaft. The resistance mechanism is only used for increasing resistance to the forward rotation of the rotating wheel, without preventing the rotary resetting of the rotating wheel. Therefore, the volute rotary resetting mechanism can be applied to some gym equipment with a pullback function. At the same time, the volute rotary resetting mechanism has a simple structure and high compatibility and is convenient to install.

The rowing machine provided by the present disclosure realizes a rotary resetting function by adopting the above-mentioned volute rotary resetting mechanism. Compared with an existing manner of generating a resilience force with an elastic string, the volute rotary resetting mechanism has a simpler structure on the rowing machine and is convenient to install. Furthermore, the volute rotary resetting mechanism can be modularized and applied to various different machine types, thus reducing the manufacturing cost. Meanwhile, compared with the elastic string, the volute spring is difficult to age and wear.

BRIEF DESCRIPTION OF THE DRAWINGS

To describe the embodiments of the present disclosure or the technical solutions in the existing art more clearly, drawings required to be used in the embodiments or the illustration of the existing art will be briefly introduced below. Obviously, the drawings in the illustration below are some embodiments of the present disclosure. Those ordinarily skilled in the art also can acquire other drawings according to the provided drawings without doing creative work.

REFERENCE NUMERALS IN THE DRAWINGS

100: rotating wheel; 110: turntable part; 111: one-way bearing;

120: resilience part; 121: volute spring; 122: volute reel; 123: hanging hole; 200: main shaft; 310: water tank; 320: paddle; 410: pulling belt; 420: pulling handle; 431: guide wheel; 432: correction wheel; 510: bottom cross beam;

520: middle cross beam; 530: top cross beam

DETAILED DESCRIPTION OF THE EMBODIMENTS

Optimal implementations of the present disclosure

Figure 1:
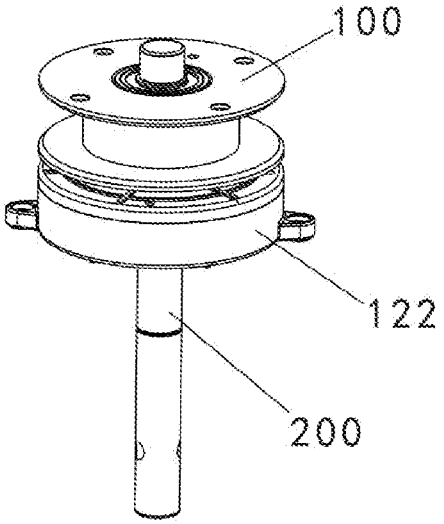
FIG. 1 is a schematic structural diagram of a volute rotary resetting mechanism provided by the present disclosure.
Figure 2:
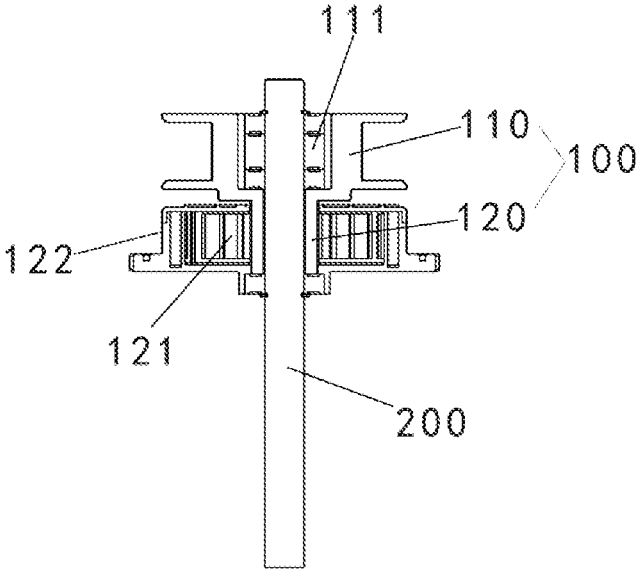
FIG. 2 is a sectional view of FIG. 1.
Figure 3:
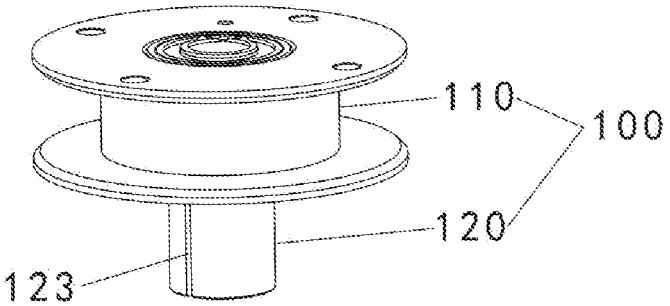
FIG. 3 is a schematic structural diagram of a rotating wheel provided by the present disclosure.

During specific implementation, as shown in FIG. 1, FIG. 2 and FIG. 3, a volute rotary resetting mechanism includes a rotating wheel 100 and a main shaft 200; the main shaft 200 is arranged in a shaft hole in the rotating wheel 100 in a penetrating manner; a turntable part 110 and a resilience part 120 are axially distributed on the rotating wheel 100; and the turntable part 110 is connected to the main shaft 200 through the one-way bearing 111, so that the rotating wheel 100 drives the main shaft 200 to rotate in one way. That is, the rotating wheel 100 may drive the main shaft 200 to rotate during forward rotation. The rotating wheel 100 may not drive the main shaft 200 to rotate during reversed rotation.

A volute spring 121 is arranged on the resilience part 120. An inner end of the volute spring 121 is fixed on the resilience part 120, and an outer end is fixed on a volute reel 122. By means of making the volute reel 122 stationary, an external force is applied to enable the rotating wheel 100 to forwardly rotate relative to the volute reel 122. The volute spring 121 is tightened to generate a resilience force when the rotating wheel 100 forwardly rotates relative to the volute reel 122. The rotating wheel 100 reversely rotates to be reset under the action of the resilience force under a low external force or when the external force is withdrawn.

The turntable part 110 and the resilience part 120 are axially distributed on the rotating wheel 100, so that the turntable part 110 and the resilience part 120 will not interfere with each other, and it is convenient to replace the volute spring 121 or a pulling component on the turntable part 110.

It should be noted that the way to apply the external force to enable the rotating wheel 100 to forwardly rotate relative to the volute reel 122 may be directly manually rotating the rotating wheel, or pulling the rotating wheel 100 to forwardly rotate by virtue of a tool such as a pulling belt 410, or placing the rotating wheel 100 on a flat ground and rolling it.

The rotating wheel 100 may drive the main shaft 200 to rotate during the forward rotation, and the rotating wheel 100 may not drive the main shaft 200 to rotate during the reversed rotation. Therefore, the rotating wheel 100 rotates to be reset under the action of the resilience force and will not drive the main shaft 200 to rotate.

The resistance mechanism used for preventing the rotating wheel 100 from forwardly rotating is arranged on the main shaft 200. The resistance mechanism is only used for increasing resistance to the forward rotation of the rotating wheel 100, without preventing the rotary resetting of the rotating wheel 100. Therefore, the volute rotary resetting mechanism can be applied to some gym equipment with a pullback function, such as a chest expander, a rowing machine and an AB roller.

Implementations of the Present Disclosure

In order to make the objectives, technical solutions and advantages of the embodiments of the present disclosure clearer, the technical solutions in the embodiments of the present disclosure will be described clearly and completely below in combination with the drawings in the embodiments of the present disclosure. Obviously, the embodiments described herein are part of the embodiments of the present disclosure, not all the embodiments. Based on the embodiments in the present disclosure, all other embodiments obtained by those of ordinary skill in the art without doing creative work shall fall within the protection scope of the present disclosure.

In the description of the present disclosure, it should be noted that orientations or positional relationships indicated by the terms "center", "longitudinal", "transverse", "upper", "lower", "front", "rear", "left", "right", "vertical", "horizontal", "top", "bottom", "inside", "outside" and the like are orientations or positional relationships as shown in the drawings, and are only for the purpose of facilitating and simplifying the description of the present disclosure instead of indicating or implying that devices or elements indicated must have particular orientations, and be constructed and operated in the particular orientations, so that these terms are construed as limiting the present disclosure. In addition, the terms "first" and "second" are only for the purpose of description, and may not be understood as indicating or implying the relative importance.

The present disclosure provides a volute rotary resetting mechanism, including a rotating wheel 100 and a main shaft 200; the main shaft 200 is arranged on the rotating wheel 100 in a penetrating manner; a turntable part 110 and a resilience part 120 are axially distributed on the rotating wheel 100; the turntable part 110 is connected to the main shaft 200 through a one-way bearing 111, so that the rotating wheel 100 drives the main shaft 200 to rotate in one way; a volute spring 121 is arranged on the resilience part 120; an inner end of the volute spring 121 is fixed on the resilience part 120, and an outer end is fixed on a volute reel 122; and the rotating wheel 100 and the volute reel 122 are relatively rotatable, so that the volute spring 121 is tightened to generate a resilience force for rotary resetting of the rotating wheel 100.

During specific implementation, as shown in FIG. 1, FIG. 2 and FIG. 3, a volute rotary resetting mechanism includes a rotating wheel 100 and a main shaft 200; the main shaft 200 is arranged in a shaft hole in the rotating wheel 100 in a penetrating manner; a turntable part 110 and a resilience part 120 are axially distributed on the rotating wheel 100; and the turntable part 110 is connected to the main shaft 200 through the one-way bearing 111, so that the rotating wheel 100 drives the main shaft 200 to rotate in one way. That is, the rotating wheel 100 may drive the main shaft 200 to rotate during forward rotation. The rotating wheel 100 may not drive the main shaft 200 to rotate during reversed rotation.

A volute spring 121 is arranged on the resilience part 120. An inner end of the volute spring 121 is fixed on the resilience part 120, and an outer end is fixed on a volute reel 122. By means of making the volute reel 122 stationary, an external force is applied to enable the rotating wheel 100 to forwardly rotate relative to the volute reel 122. The volute spring 121 is tightened to generate a resilience force when the rotating wheel 100 forwardly rotates relative to the volute reel 122. The rotating wheel 100 reversely rotates to be reset under the action of the resilience force under a low external force or when the external force is withdrawn.

The turntable part 110 and the resilience part 120 are axially distributed on the rotating wheel 100, so that the turntable part 110 and the resilience part 120 will not interfere with each other, and it is convenient to replace the volute spring 121 or a pulling component on the turntable part 110.

It should be noted that the way to apply the external force to enable the rotating wheel 100 to forwardly rotate relative to the volute reel 122 may be directly manually rotating the rotating wheel, or pulling the rotating wheel 100 to forwardly rotate by virtue of a tool such as a pulling belt 410, or placing the rotating wheel 100 on a flat ground and rolling it.

The rotating wheel 100 may drive the main shaft 200 to rotate during the forward rotation, and the rotating wheel 100 may not drive the main shaft 200 to rotate during the reversed rotation. Therefore, the rotating wheel 100 rotates to be reset under the action of the resilience force and will not drive the main shaft 200 to rotate.

The resistance mechanism used for preventing the rotating wheel 100 from forwardly rotating is arranged on the main shaft 200. The resistance mechanism is only used for increasing resistance to the forward rotation of the rotating wheel 100, without preventing the rotary resetting of the rotating wheel 100. Therefore, the volute rotary resetting mechanism can be applied to some gym equipment with a pullback function, such as a chest expander, a rowing machine and an AB roller.

According to the volute rotary resetting mechanism provided by the present disclosure, the turntable part and the resilience part are axially distributed on the rotating wheel, so that it is convenient to replace the volute spring or a pulling component on the turntable part. The two ends of the volute spring are respectively fixed to the resilience part and the volute reel; the rotating wheel and the volute reel are relatively rotatable, so that the volute spring is tightened to generate a resilience force; and the turntable part is connected to the main shaft through the one-way bearing, so that the rotating wheel will not drive the main shaft to rotate during rotary resetting. The resistance mechanism used for preventing the rotating wheel from forwardly rotating can be arranged on the main shaft. The resistance mechanism is only used for increasing resistance to the forward rotation of the rotating wheel, without preventing the rotary resetting of the rotating wheel. Therefore, the volute rotary resetting mechanism can be applied to some gym equipment with a pullback function. At the same time, the volute rotary resetting mechanism has a simple structure and high compatibility and is convenient to install.

Preferably, two ends of the volute spring 121 are respectively fastened with hanging holes 123 in the volute reel 122 and the resilience part 120.

Figure 4:
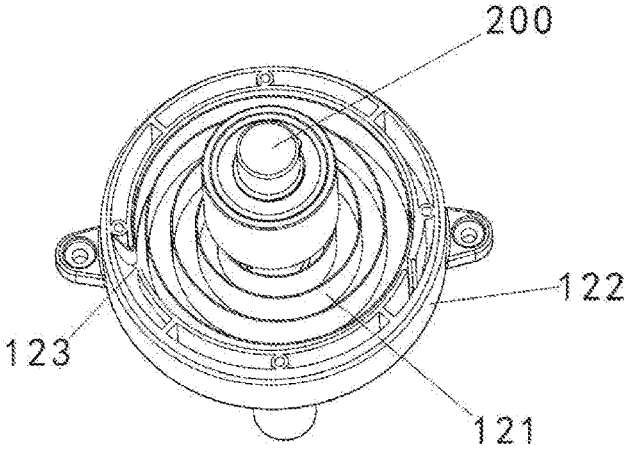
FIG. 4 is a schematic diagram of an interior of a volute reel provided by the present disclosure.

During specific implementation, as shown in FIG. 3 and FIG. 4, the hanging holes 123 are formed in both the volute reel 122 and the resilience part 120; two ends of the volute spring 121 are bent to form hooks which are respectively hooked into the hanging holes 123 in the volute reel 122 and the resilience part 120 to achieve fastening, which is convenient for removal and mounting.

Preferably, a material of the rotating wheel 100 is plastic or aluminum alloy.

During specific implementation, the material of the rotating wheel 100 is the plastic or aluminum alloy. The plastic has the advantages of low cost and easiness in machining. The aluminum alloy has the advantage of attractive appearance, and the aluminum alloy has good heat conduction performance and easily dissipates heat.

The present disclosure further provides a rowing machine adopting any of the above volute rotary resetting mechanisms. One end of the main shaft 200 is provided with a resistance mechanism used for preventing the rotating wheel 100 from rotating; and a handheld mechanism used for pulling the rotating wheel 100 to rotate is arranged on the turntable part 110.

Figure 5:
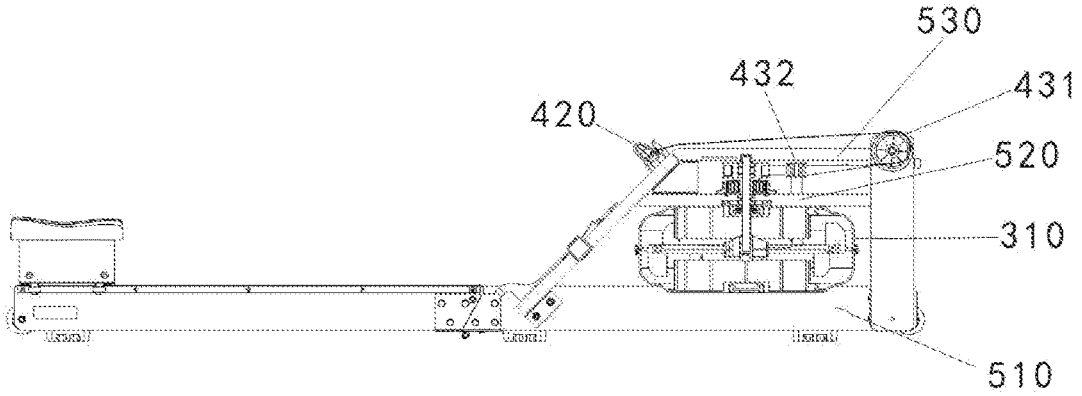
FIG. 5 is a schematic structural diagram of a rowing machine provided by the present disclosure.
Figure 6:
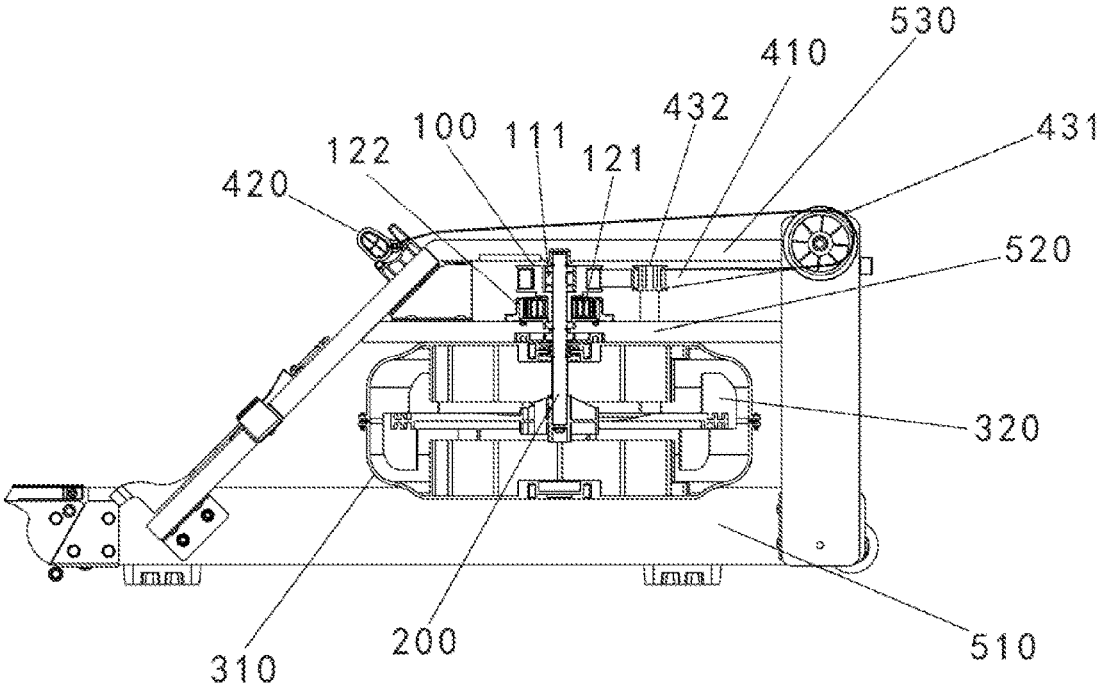
FIG. 6 is a schematic partial diagram of FIG. 5.

During specific implementation, as shown in FIG. 5 and FIG. 6, according to a rowing machine adopting any of the above volute rotary resetting mechanisms, the volute reel 122 is fixed on a body of the rowing machine. One end of the main shaft 200 is provided with the resistance mechanism used for preventing the rotating wheel 100 from forwardly rotating. The resistance mechanism may be a water resistor or a magnet resistor for increasing resistance to the forward rotation of the rotating wheel 100. The handheld mechanism used for pulling the rotating wheel 100 to forwardly rotate is arranged on the turntable part 110. A user pulls the handheld mechanism to drive the rotating wheel 100 to forwardly rotate, and the volute spring 121 is tightened. The rotating wheel 100 will not drive the main shaft 200 and the resistance mechanism on the main shaft 200 to rotate during the reversed rotation. Therefore, when the user withdraws the pulling force, the rotating wheel 100 may easily rotate to be reset under the action of the resilience force of the volute spring 121, and drive the handheld mechanism to be reset at the same time. The user can do exercise in a reciprocating manner.

The rowing machine provided by the present disclosure realizes a rotary resetting function by adopting the above-mentioned volute rotary resetting mechanism. Compared with an existing manner of generating a resilience force with an elastic string, the volute rotary resetting mechanism has a simpler structure on the rowing machine and is convenient to install. Furthermore, the volute rotary resetting mechanism can be modularized and applied to various different machine types, thus reducing the manufacturing cost. Meanwhile, compared with the elastic string, the volute spring is difficult to age and wear.

Preferably, the resistance mechanism includes a water tank 310 and a paddle 320 arranged in the water tank 310. The paddle 320 is fixed on the main shaft 200.

During specific implementation, as shown in FIG. 5 and FIG. 6, the resistance mechanism adopts a water resistor, specifically including the water tank 310 and the paddle 320 arranged in the water tank 310. The paddle 320 is fixed on the main shaft 200. The rotating wheel 100 drives the main shaft 200 and the paddle 320 to rotate when it forwardly rotates. The paddle 320 can generate resistance when it rotates in water. The user can adjust the water volume in the water tank 310 according to a need for an exercise intensity to achieve fast adjustment of different exercise intensities. Meanwhile, the water resistor has the advantages that the user can hear the sound of flowing water when doing exercise. Since the sound of flowing water of the nature is simulated, the user has an outdoor gym experience. In addition, when it is necessary to carry the rowing machine, the water in the water tank 310 can be emptied to reduce the weight.

Preferably, the handheld mechanism includes a pulling handle 420 and a pulling belt 410; and one end of the pulling belt 410 is fixed with the pulling handle 420, and the other end is fixed on the turntable part 110.

During specific implementation, as shown in FIG. 5 and FIG. 6, the handheld mechanism includes the pulling handle 420 and the pulling belt 410; and one end of the pulling belt 410 is fixed with the pulling handle 420, and the other end is fixed on the turntable part 110. The user holds the pulling handle 420 with a hand to pull the pulling belt 410 to pull the rotating wheel 100 to forwardly rotate.

Preferably, the pulling belt 410 is a nylon woven belt.

During specific implementation, the pulling belt 410 adopts the nylon woven belt, so that it has the advantages of low price, difficulty in wearing and long service life.

Preferably, the rowing machine further includes a main frame 500 used for mounting the volute rotary resetting mechanism, the resistance mechanism and the handheld mechanism; the main frame includes a bottom cross beam 510, a middle cross beam 520 and a top cross beam 530 which are disposed from bottom to top; the water tank 310 is located between the bottom cross beam 510 and the middle cross beam 520; the rotating wheel 100 is located between the middle cross beam 520 and the top cross beam 530; and the volute reel 122 is fixed on the middle cross beam 520.

During specific implementation, as shown in FIG. 5 and FIG. 6, the rowing machine further includes the main frame 500 used for mounting the volute rotary resetting mechanism, the resistance mechanism and the handheld mechanism; the main frame includes the bottom cross beam 510, the middle cross beam 520 and the top cross beam 530 which are disposed from bottom to top; the water tank 310 is located between the bottom cross beam 510 and the middle cross beam 520; the rotating wheel 100 is mounted between the middle cross beam 520 and the top cross beam 530; and the volute reel 122 is fixed on the middle cross beam 520 through a bolt.

As shown in FIG. 6, the main shaft 200 is vertically disposed. The main shaft 200 passes through the middle cross beam 520. One end of the main shaft 200 located below the middle cross beam 520 is located in the water tank 310, and one end located above the middle cross beam 520 is connected to the turntable part 110 of the rotating wheel 100 through a one-way bearing 111.

A correction wheel 432 is arranged on a left side of the rotating wheel 100. Th pulling belt 410 is changed from vertical arrangement to horizontal arrangement through the correction wheel 432, and the moving direction of the pulling belt 410 is changed via a guide wheel 431 arranged at one end of a top right corner of the main frame. One end of the pulling belt 410 is connected to the turntable part 110, then passes the correction wheel 432 and the guide wheel 431 in sequence, and is connected to the pulling handle 420. The user pulls the pulling handle 420 against the resistance to drive the rotating wheel 100 to rotate, thus achieving the purpose of exercise.

It should be noted that the rowing machine of this embodiment further includes a seat cushion, a pedal, a display screen and almost all elements provided on this type of product in the market. The structure and using principle of the rowing machine are not repeatedly described here.

In addition, those skilled in the art can combine the volute rotary resetting mechanism provided by the present disclosure with resistance mechanisms and handheld mechanisms of other gym equipment to achieve a design capable of realizing corresponding rotary resetting, particularly some gym equipment with a pullback function, such as a chest expander and an AB roller. By the adoption of the volute rotary resetting mechanism, the rowing machine has a simple structure and is convenient to install. At the same time, compared with an elastic string for generating a resilience force, the volute rotary resetting mechanism is difficult to age and wear, and the maintenance cost of equipment is reduced.

Many terms such as rotating wheel, main shaft, water tank, turntable part, one-way bearing, paddle, resilience part, volute spring, pulling belt, volute reel, pulling handle, hanging hole, guide wheel, correction wheel, bottom cross beam, middle cross beam, and top cross beam are used herein, but the possibility of using other terms is not excluded. These terms are used only to more conveniently describe and explain the essence of the present disclosure; and it is contrary to the spirit of the present disclosure to interpret them as any kind of additional limitations.

It should be finally noted that the above various embodiments are only used to describe the technical solutions of the present disclosure, and not intended to limit the present disclosure. Although the present disclosure has been described in detail with reference to the foregoing embodiments, those ordinarily skilled in the art should understand that they can still modify the technical solutions described in all the foregoing embodiments, or equivalently replace some or all of the technical features, and these modifications or replacements do not depart the essences of the corresponding technical solutions from the spirit and scope of the technical solutions of all the embodiments of the present disclosure.

INDUSTRIAL PRACTICABILITY

A volute rotary resetting mechanism includes a rotating wheel and a main shaft; the main shaft is arranged on the rotating wheel in a penetrating manner; a turntable part and a resilience part are axially distributed on the rotating wheel; the turntable part is connected to the main shaft through the one-way bearing, so that the rotating wheel drives the main shaft to rotate in one way; a volute spring is arranged on the resilience part; an inner end of the volute spring is fixed on the resilience part, and an outer end is fixed on a volute reel; and the rotating wheel and the volute reel are relatively rotatable, so that the volute spring is tightened to generate a resilience force for rotary resetting of the rotating wheel. In the mechanism, the turntable part and the resilience part are axially distributed on the rotating wheel, so that it is convenient to replace the volute spring or a pulling component on the turntable part. The volute rotary resetting mechanism can be applied to some gym equipment with a pullback function. At the same time, the volute rotary resetting mechanism has a simple structure and high compatibility and is convenient to install.

What is claimed is:

1. A volute rotary resetting mechanism, comprising a rotating wheel (100) and a main shaft (200), wherein the main shaft (200) is arranged on the rotating wheel (100) in a penetrating manner;

a turntable part (110) and a resilience part (120) are axially distributed on the rotating wheel (100); the turntable part (110) is connected to the main shaft (200) through a one-way bearing (111), so that the rotating wheel (100) drives the main shaft (200) to rotate in one way;

a volute spring (121) is arranged on the resilience part (120); an inner end of the volute spring (121) is fixed on the resilience part (120), and an outer end is fixed on a volute reel (122); and the rotating wheel (100) and the volute reel (122) are relatively rotatable, so that the volute spring (121) is tightened to generate a resilience force for rotary resetting of the rotating wheel (100).

2. The volute rotary resetting mechanism according to claim 1, wherein two ends of the volute spring (121) are respectively fastened with hanging holes (123) in the volute reel (122) and the resilience part (120).

3. The volute rotary resetting mechanism according to claim 1, wherein a material of the rotating wheel (100) is plastic or aluminum alloy.

4. The volute rotary resetting mechanism according to claim 1, wherein one end of the main shaft (200) is provided with a resistance mechanism used for preventing the rotating wheel (100) from rotating.

5. The volute rotary resetting mechanism according to claim 4, wherein the resistance mechanism is a water resistor or a magnet resistor.

6. The volute rotary resetting mechanism according to claim 5, wherein the water resistor comprises a water tank (310) and a paddle (320) arranged in the water tank (310); and the paddle (320) is fixed on the main shaft (200).

7. The volute rotary resetting mechanism according to claim 1, wherein a handheld mechanism used for pulling the rotating wheel (100) to rotate is arranged on the turntable part (110).

8. The volute rotary resetting mechanism according to claim 7, wherein the handheld mechanism comprises a pulling handle (420) and a pulling belt (410); and one end of the pulling belt (410) is fixed with the pulling handle (420), and the other end is fixed on the turntable part (110).

9. The volute rotary resetting mechanism according to claim 8, wherein the pulling belt (410) is a nylon woven belt.

10. A rowing machine, comprising a rotating wheel (100) and a main shaft (200), wherein the main shaft (200) is arranged on the rotating wheel (100) in a penetrating manner;

a turntable part (110) and a resilience part (120) are axially distributed on the rotating wheel (100);

the turntable part (110) is connected to the main shaft (200) through a one-way bearing (111), so that the rotating wheel (100) drives the main shaft (200) to rotate in one way;

a volute spring (121) is arranged on the resilience part (120); an inner end of the volute spring (121) is fixed on the resilience part (120), and an outer end is fixed on a volute reel (122); the rotating wheel (100) and the volute reel (122) are relatively rotatable, so that the volute spring (121) is tightened to generate a resilience force for rotary resetting of the rotating wheel (100);

one end of the main shaft (200) is provided with a resistance mechanism used for preventing the rotating wheel (100) from rotating; and a handheld mechanism used for pulling the rotating wheel (100) to rotate is arranged on the turntable part (110).

11. The rowing machine according to claim 10, wherein two ends of the volute spring (121) are respectively fastened with hanging holes (123) in the volute reel (122) and the resilience part (120).

12. The rowing machine according to claim 10, wherein a material of the rotating wheel (100) is plastic or aluminum alloy.

13. The rowing machine according to claim 10, wherein the resistance mechanism is a water resistor or a magnet resistor.

14. The rowing machine according to claim 13, wherein the water resistor comprises a water tank (310) and a paddle (320) arranged in the water tank (310); and the paddle (320) is fixed on the main shaft (200).

15. The rowing machine according to claim 10, wherein the handheld mechanism comprises a pulling handle (420) and a pulling belt (410); and one end of the pulling belt (410) is fixed with the pulling handle (420), and the other end is fixed on the turntable part (110).

16. The rowing machine according to claim 15, wherein the pulling belt (410) is a nylon woven belt.

17. The rowing machine according to claim 10, further comprising a main frame (500) used for mounting the volute rotary resetting mechanism, the resistance mechanism and the handheld mechanism, wherein the main frame comprises a bottom cross beam (510), a middle cross beam (520) and a top cross beam (530) which are disposed from bottom to top; a water tank (310) is located between the bottom cross beam (510) and the middle cross beam (520); the rotating wheel (100) is located between the middle cross beam (520) and the top cross beam (530); and the volute reel (122) is fixed on the middle cross beam (520).

18. The rowing machine according to claim 17, wherein a correction wheel (432) and a guide wheel (431) for changing a moving direction of the pulling belt (410) are further arranged on the main frame.

* * * * *